US011155442B2

(12) United States Patent
Ericson

(10) Patent No.: US 11,155,442 B2
(45) Date of Patent: Oct. 26, 2021

(54) TERMINATION FOR ELEVATOR BELT

(71) Applicant: OTIS ELEVATOR COMPANY, Farmington, CT (US)

(72) Inventor: Richard J. Ericson, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 177 days.

(21) Appl. No.: 15/537,185

(22) PCT Filed: Dec. 18, 2015

(86) PCT No.: PCT/US2015/066587
§ 371 (c)(1),
(2) Date: Jun. 16, 2017

(87) PCT Pub. No.: WO2016/100775
PCT Pub. Date: Jun. 23, 2016

(65) Prior Publication Data

US 2017/0369282 A1 Dec. 28, 2017

Related U.S. Application Data

(60) Provisional application No. 62/094,473, filed on Dec. 19, 2014.

(51) Int. Cl.
*B66B 7/08* (2006.01)

(52) U.S. Cl.
CPC ..... *B66B 7/085* (2013.01)

(58) Field of Classification Search
CPC ..... B66B 7/085; F16G 11/04; F16G 11/044; F16G 11/048; F16G 11/05; H02G 7/056; H02G 15/06
See application file for complete search history.

(56) References Cited

U.S. PATENT DOCUMENTS 875,121 A * 12/1907 Shryock ..... F16G 11/10 24/136 A
1,165,583 A * 12/1915 Farmer ..... F16D 59/00 188/189

(Continued)

FOREIGN PATENT DOCUMENTS

CN 1633389 A 6/2005
CN 102120539 A 7/2011

(Continued)

OTHER PUBLICATIONS

International Search Report and Written Opinion; International Application No. PCT/US2015/066587; International Filing Date: Dec. 18, 2015; dated Apr. 6, 2016; 6 pages.

(Continued)

*Primary Examiner* — Minh Truong
(74) *Attorney, Agent, or Firm* — Cantor Colburn LLP

(57) ABSTRACT

A termination assembly (28) for an elevator belt (16) includes a termination body (40) and a fixed wedge (48) secured to the termination body (40) and having a plurality of fixed wedge surfaces (52). A moving wedge (56) is located in the termination body (40) and has a plurality of moving wedge surfaces (60) interactive with the fixed wedge surfaces (52). When an elevator belt (16) is inserted into the termination body (40) between the moving wedge (56) and the termination body (40) and a tension load is applied to the elevator belt (16), the moving wedge surfaces (60) are urged to move relative to the fixed wedge surfaces (52) to apply a contact pressure to the elevator belt (16) thus retaining the elevator belt (16) at the termination body (40).

15 Claims, 5 Drawing Sheets

(56) References Cited

U.S. PATENT DOCUMENTS

| | | | | | |
|---|---|---|---|---|---|
| 2,058,549 | A * | 10/1936 | Austin | F16G 11/04 | 24/136 R |
| 2,719,608 | A * | 10/1955 | Callaway | B66B 5/22 | 187/411 |
| 3,494,002 | A * | 2/1970 | Heinrich | F16G 11/048 | 24/16 PB |
| 3,762,512 | A * | 10/1973 | McIntyre | B66B 5/22 | 188/189 |
| 4,615,509 | A * | 10/1986 | Biass | B66D 3/006 | 254/228 |
| 4,643,609 | A * | 2/1987 | Biass | F16B 2/14 | 24/122.3 |
| 5,022,125 | A * | 6/1991 | Biass | B66D 3/006 | 24/136 A |
| 5,526,552 | A | 6/1996 | De Angelis | | |
| 5,855,254 | A | 1/1999 | Blochle | | |
| 6,061,879 | A | 5/2000 | Ericson et al. | | |
| 6,341,669 | B1 | 1/2002 | St. Pierre et al. | | |
| 6,353,979 | B1 | 3/2002 | Traktovenko | | |
| 6,854,164 | B2 | 2/2005 | Bass et al. | | |
| 6,994,487 | B2 | 2/2006 | Traktovenko et al. | | |
| 8,096,024 | B2 | 1/2012 | Smith et al. | | |
| 2005/0066482 | A1* | 3/2005 | De France | H02G 7/056 | 24/136 R |
| 2007/0017749 | A1* | 1/2007 | Dold | B66B 7/085 | 187/251 |
| 2007/0034454 | A1 | 2/2007 | Dold et al. | | |
| 2013/0143705 | A1 | 6/2013 | Wolf | | |
| 2014/0182975 | A1* | 7/2014 | Ikonen | B66B 5/0031 | 187/251 |
| 2021/0018064 | A1* | 1/2021 | Patel | F16G 11/048 | |

FOREIGN PATENT DOCUMENTS

| | | | |
|---|---|---|---|
| DE | 202007004017 | U1 | 5/2007 |
| EP | 2354073 | A1 | 8/2011 |
| EP | 2749520 | A2 | 7/2014 |
| JP | 09132366 | A | 5/1997 |
| JP | 2001316059 | A | 11/2001 |
| JP | 2004338935 | A | 12/2004 |
| KR | 20090066048 | A | 6/2009 |
| WO | 2009003815 | A1 | 1/2009 |
| WO | 2009050113 | A1 | 4/2009 |
| WO | 2013004899 | A1 | 1/2013 |
| WO | 2013055308 | A1 | 4/2013 |

OTHER PUBLICATIONS

Chinese Office Action Issued in CN Application No. 201580069565.8, dated Aug. 28, 2018, 5 Pages.

Vogel, Dr.-Ing, et al.; "The Use of Thin Steel Wire Ropes in Traction Sheave Elevators", LR Magazine, Schwelmer Symposium, Jun. 3-4, 2019, Accessed Online: Jun. 13, 2019, 3 Pages. URL: https://www.lift-report.de/index.php/en/.

Chinese Office Action for Chinese Application No. 201580069565.8; dated Oct. 14, 2020, 8 pages.

* cited by examiner

TERMINATION FOR ELEVATOR BELT

CROSS-REFERENCE TO RELATED APPLICATIONS

This application is a National Stage application of PCT/US2015/066,587 filed on Dec. 18, 2015, which claims the benefit of U.S. Provisional Application No. 62/094,473, filed Dec. 19, 2014, which are incorporated herein by reference in their entirety.

BACKGROUND

The subject matter disclosed herein relates to elevator systems having tension members for suspension and/or driving of the elevator car and/or counterweight.

Conventional elevator systems use rope formed from steel wires as a lifting tension load bearing member. Other systems utilize a lifting belt formed from a number of steel cords, formed from steel wires, retained in an elastomeric jacket. The cords act as the load supporting tension member, while the elastomeric jacket holds the cords in a stable position relative to each other, and provides a frictional load path to provide traction for driving the belt. For ultra-high rise applications, forming the cords from a carbon fiber material is considered advantageous because of considerable weight savings to the belt over the increased length of the belt.

In a typical steel cord belt system, termination devices are utilized at ends of the belt, often at the car or counterweight, or in the hoistway, to retain ends of the belt. These termination devices require bending of the belt to engage the belt into the termination device, with the bend radius often being about 12 millimeters or less. Use of such a termination with carbon fiber cord belts requires bending of the carbon fiber cords to tight radii such as those above and results in cracking and/or breakage of the carbon fiber material, thereby weakening the belt. Further, the carbon fiber members have a relatively low compressive strength, so that clamping pressure on the belt at the termination must be low enough to prevent crushing the carbon fibers.

BRIEF SUMMARY

In one embodiment, a termination assembly for an elevator belt includes a termination body and a fixed wedge secured to the termination body and having a plurality of fixed wedge surfaces. A moving wedge is located in the termination body and has a plurality of moving wedge surfaces interactive with the fixed wedge surfaces. When an elevator belt is inserted into the termination body between the moving wedge and the termination body and a tension load is applied to the elevator belt, the moving wedge surfaces are urged to move relative to the fixed wedge surfaces to apply a contact pressure to the elevator belt thus retaining the elevator belt at the termination body.

Additionally or alternatively, in this or other embodiments a bearing assembly is located between and interactive with the plurality of moving wedge surfaces and the plurality of fixed wedge surfaces.

Additionally or alternatively, in this or other embodiments the bearing assembly includes a plurality of roller elements retained in a roller cage.

Additionally or alternatively, in this or other embodiments the termination body is a tubular member.

Additionally or alternatively, in this or other embodiments the fixed wedge surfaces are nonparallel to a rear face of the fixed wedge, the rear face being furthest from the moving wedge.

Additionally or alternatively, in this or other embodiments the moving wedge surfaces are parallel to the fixed wedge surfaces.

Additionally or alternatively, in this or other embodiments the plurality of moving wedge surfaces is three moving wedge surfaces and the plurality of fixed wedge surfaces in three fixed wedge surfaces.

In another embodiment, an elevator system includes an elevator car suspended in a hoistway via an elevator belt. A termination assembly secures the elevator belt at an end of the elevator belt. The termination assembly includes a termination body and a fixed wedge secured to the termination body and having a plurality of fixed wedge surfaces. A moving wedge is located in the termination body and has a plurality of moving wedge surfaces interactive with the fixed wedge surfaces. When the elevator belt is inserted into the termination body between the moving wedge and the termination body and a tension load is applied to the elevator belt, the moving wedge surfaces are urged to move relative to the fixed wedge surfaces to apply a contact pressure to the elevator belt thus retaining the elevator belt at the termination body.

Additionally or alternatively, in this or other embodiments a bearing assembly is positioned disposed between and interactive with the plurality of moving wedge surfaces and the plurality of fixed wedge surfaces.

Additionally or alternatively, in this or other embodiments the bearing assembly includes a plurality of roller elements retained in a roller cage.

Additionally or alternatively, in this or other embodiments the termination body is a tubular member.

Additionally or alternatively, in this or other embodiments the fixed wedge surfaces are nonparallel to a rear face of the fixed wedge, the rear face being furthest from the moving wedge.

Additionally or alternatively, in this or other embodiments the moving wedge surfaces are parallel to the fixed wedge surfaces.

Additionally or alternatively, in this or other embodiments the plurality of moving wedge surfaces is three moving wedge surfaces and the plurality of fixed wedge surfaces in three fixed wedge surfaces.

Additionally or alternatively, in this or other embodiments the termination is located at the elevator car.

Additionally or alternatively, in this or other embodiments the elevator belt is in an unbent orientation in the termination body.

Additionally or alternatively, in this or other embodiments tension members of the belt are formed at least partially from a carbon fiber material.

In yet another embodiment, a method of terminating an elevator belt includes urging a belt end through a termination body of a termination assembly in a first direction, between the termination body and a moving wedge. The belt is urged in a second direction opposite the first direction, thereby urging movement of the moving wedge relative to a fixed wedge. The moving wedge has a plurality of moving wedge surfaces interactive with a plurality of fixed wedge surfaces of the fixed wedge. The moving wedge is urged into contact with the elevator belt via the interaction between the moving wedge and the fixed wedge, thus applying a contact pressure to the elevator belt to retain the elevator belt at the termination body.

Additionally or alternatively, in this or other embodiments a compressive force is transmitted from the fixed wedge to the moving wedge via a bearing assembly disposed between the fixed wedge and the moving wedge.

The detailed description explains the invention, together with advantages and features, by way of examples with reference to the drawings.

DETAILED DESCRIPTION

Figure 1A:
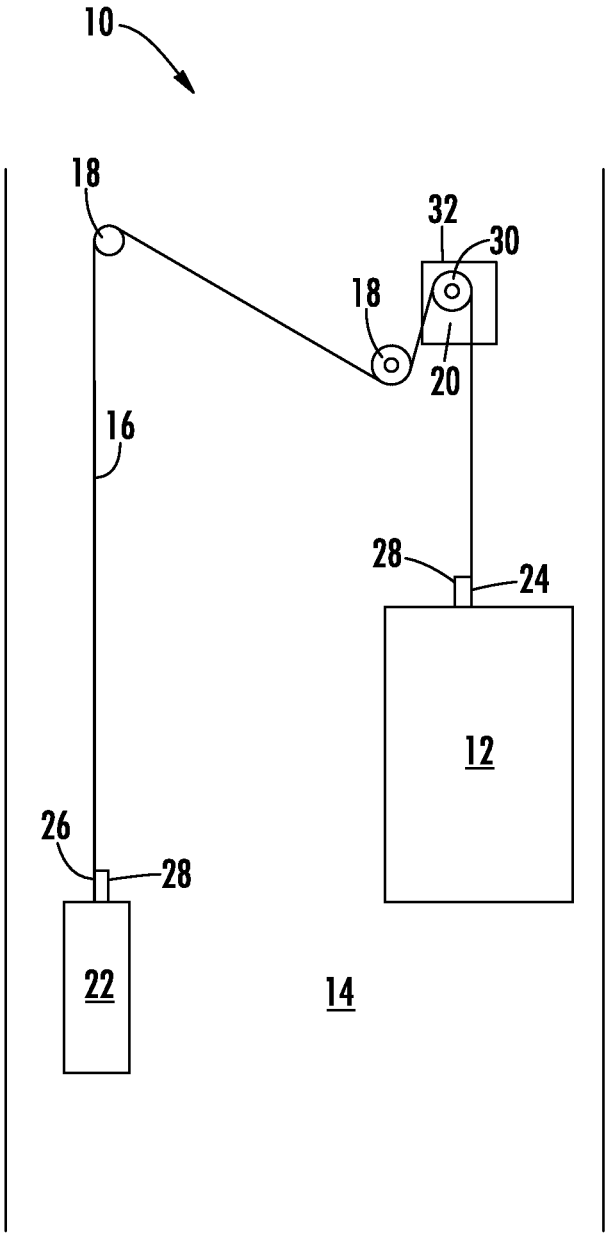
FIG. 1A is a schematic of an exemplary elevator system having a 1:1 roping arrangement.
Figure 1B:
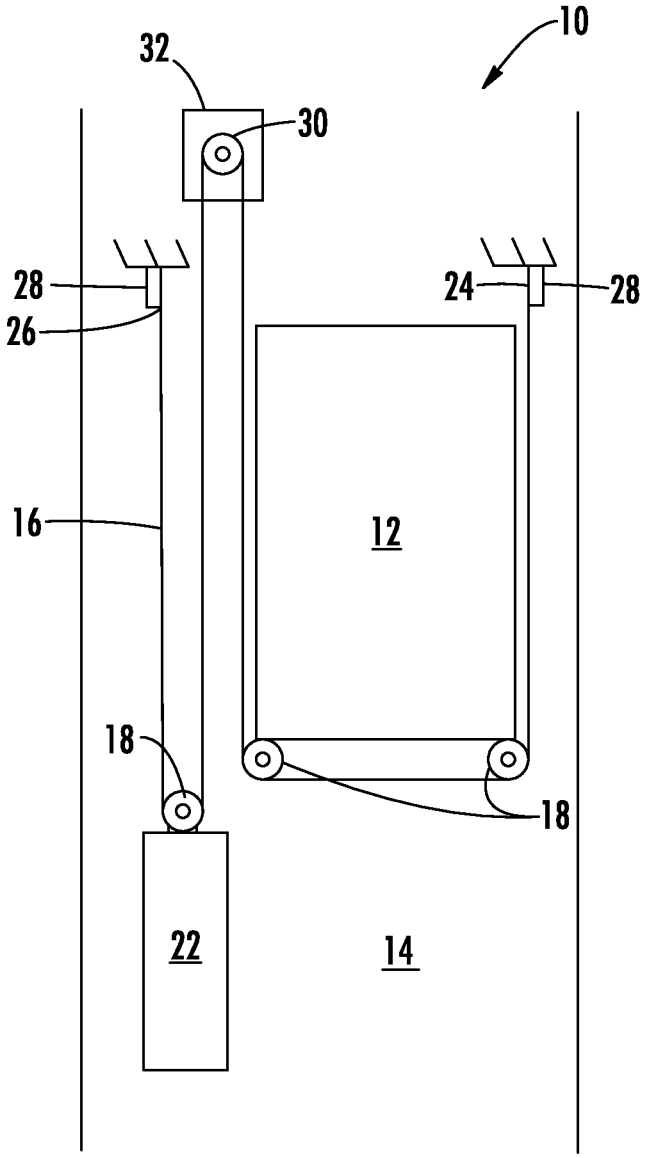
FIG. 1B is a schematic of another exemplary elevator system having a different roping arrangement.
Figure 1C:
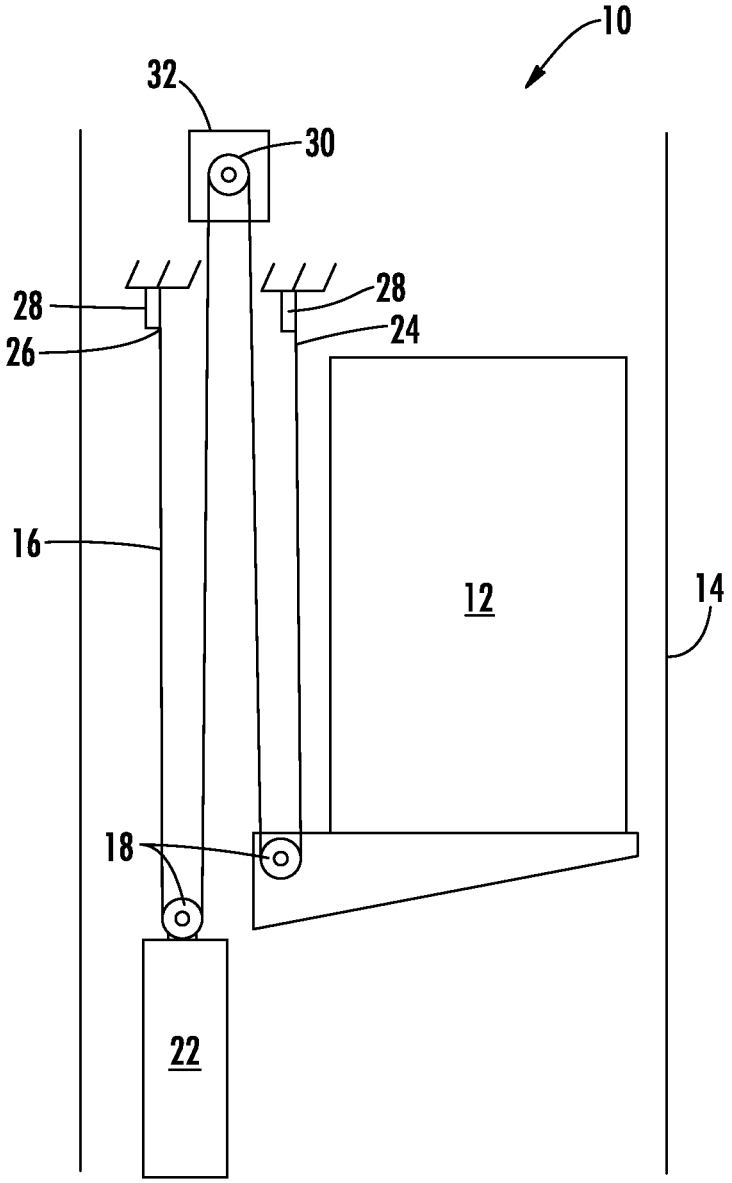
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation. The belts 16 are retained at belt ends 24, 26 via a termination mechanism 28, described in more detail below.

The sheaves 18 each have a diameter 20, which may be the same or different than the diameters of the other sheaves 18 in the elevator system 10. At least one of the sheaves could be a traction sheave 30. The traction sheave 30 is driven by a machine 32. Movement of drive sheave by the machine 32 drives, moves and/or propels (through traction) the one or more belts 16 that are routed around the traction sheave 30.

At least one of the sheaves 18 could be a diverter, deflector or idler sheave. Diverter, deflector or idler sheaves are not driven by the machine 32, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIGS. 1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machineroomless elevator system) or within the machine room (for elevator systems utilizing a machine room. The number of sheaves 18 used in the arrangement determines the specific roping ratio (e.g. the 2:1 roping ratio shown in FIGS. 1B and 1C or a different ratio). FIG. 1C also provides a so-called rucksack or cantilevered type elevator. The present invention could also be used on elevator systems other than the exemplary types shown in FIGS. 1A, 1B and 1C. Further, while embodiments discussed are related to belts 16 for hoisting or suspending the elevator car 12 (hoist belts), one skilled in the art will readily appreciate that the present disclosure may be readily applied to compensation belts of elevator systems, used to steady or balance elevator systems, especially in high-rise applications.

Figure 2:
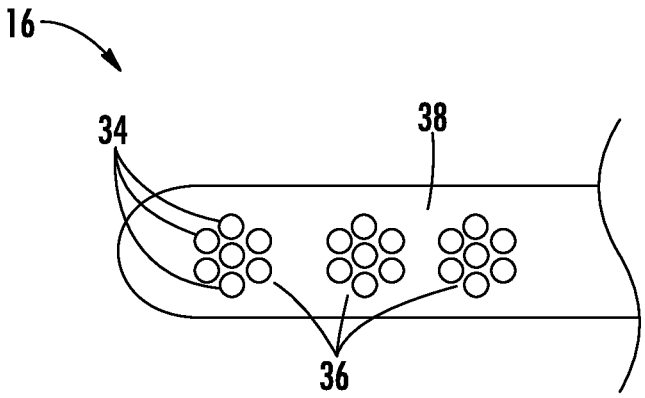
FIG. 2 is a cross-sectional view of an embodiment of an elevator belt.

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12. FIG. 2 provides a schematic of an exemplary belt 16 construction or design. The belt 16 includes a plurality of tension elements 34 extending longitudinally along the belt 16. The tension elements 34 are arranged generally parallel to each other and extend in a longitudinal direction that establishes a length of the belt 16. In exemplary embodiments, the tension elements 34 are arranged into cords 36, and at least partially retained in a jacket 38 formed from, for example, an elastomeric material. In exemplary embodiments, the tension elements 34 are formed from a carbon fiber material. It is to be appreciated, however, that other embodiments of tension members 34 may be formed from additional or other materials, such as steel or combinations of steel and carbon fiber.

Figure 3:
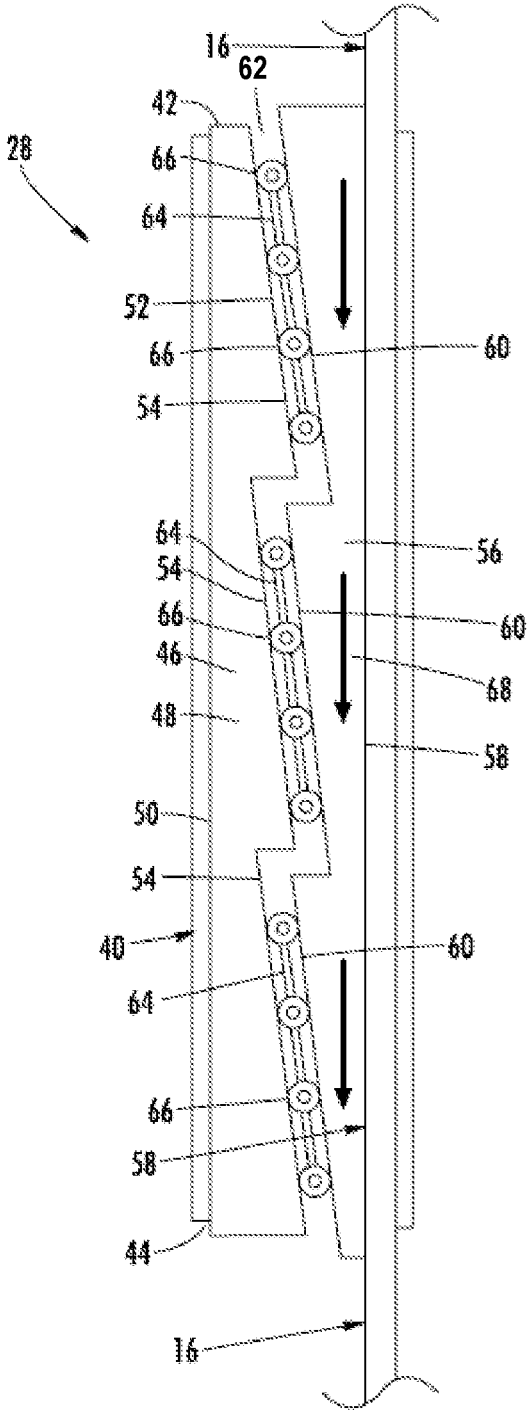
FIG. 3 is a cross-sectional view of an embodiment of a termination assembly for an elevator belt.

The belts 16 are retained at belt ends 24, 26 via a termination mechanism 28, an embodiment of which is shown in FIG. 3. The termination 28 is fixed to, for example, the elevator car 12 or other structure of the elevator system 10, such as the counterweight 22, traction sheave 30 or hoistway 14 wall. The termination 28 includes a termination body 40 which in some embodiments is tubular and may have a rectangular cross-section with open ends 42 and 44. The belt 16 passes through the termination body 40 via the open ends 42 and 44 and is retained at the termination 28 via a Z-wedge clamping assembly 46. The clamping assembly 46 includes a fixed wedge 48 having a rear face 50 fixed to the termination body 40 via, for example, bolts, pins, welding, or the like. A fixed z-wedge face 52 of the fixed wedge 48 is located opposite to the rear face 50 and includes two or more fixed wedge segments 54 positioned nonparallel to the rear face 50. A movable wedge 56 is positioned in the termination body 40 between the belt 16 and the fixed wedge 48. The movable wedge 56 has a movable rear face 58 with a high coefficient of friction to engage the belt 16, and has a plurality of movable wedge segments 60 opposite the movable rear face 58. To provide the high friction required to engage the belt 16, the rear face 58 may have surface coatings or treatments or patterns, such as, for example, a raised diamond pattern or a knurled pattern. The movable wedge segments 60 are configured and arranged to be parallel to the fixed wedge segments 54. In some embodiments, the wedges 48 and 56 are metallic and formed from, for example, sintered metal, steel or cast aluminum.

A bearing assembly 62 is located between the fixed wedge segments 54 and the movable wedge segments 60, and includes a flat roller cage 64 including a plurality of roller elements 66 at each fixed wedge segment 54/movable wedge segment 60 to control movement of the movable wedge 56 relative to the fixed wedge 48. The roller cages 64 may be fixed to, for example, the fixed wedge 48 or the termination body 40 to maintain the roller cage 64 position in the termination body 40. The roller cage 64 provides a low friction surface for movement of the movable wedge 56 relative to the fixed wedge 48, but such low friction may be provided in other ways in other embodiments. In some embodiments the roller cage 64 may be replaced with a low friction surface on one or both of the movable wedge segments 60 or the fixed wedge segments 64 of, for example, Teflon or UHMW (Ultra high molecular weight polyethylene).

In operation, the belt 16 is loaded into the termination 28 through the termination body 40, opposite a clamping direction 68 and located between the termination body 40 and the movable rear face 58 of the movable wedge 56. The belt 16 is then pulled in the clamping direction 68, for example, downwardly in FIG. 3. As the belt 16 is pulled in the clamping direction 68, the belt 16 engages the movable rear face 58, moving the movable wedge 56 in the clamping direction 68. Due to the orientation of the movable wedge segments 60 and the fixed wedge segments 54, this movement has the effect of urging the movable wedge 56 toward the belt 16 and exerting a clamping pressure, together with the termination body 40, on the belt 16. The clamping pressure retains the belt 16 at the termination 28.

To prevent crushing of the carbon fibers due to the contact pressure, multiple fixed wedge segments 54 and moving wedge segments 60 are utilized as shown in FIG. 3. Depending on the maximum allowable pressure on the carbon fibers and jacket material, the number of z wedge sections and wedge angle can be varied in order to achieve an optimal result with regard to the specific carbon fiber belt characteristics. Additionally, in some embodiments, the termination includes a transitional entry radius at a point where the belt 16 enters the termination in order to provide a gradual change in pressure and so as to not pinch the belt 16 with a sudden step transition as it enters the termination. Further, the termination retains the belt 16 without bending, thus preventing cracking and/or breaking. Also, the belt 16 may be assembled into the termination 28 without the use of tools, as it merely requires insertion of the belt 16 into the termination 28, then pulling on the belt 16 to engage the locking feature.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A termination assembly for an elevator belt comprising:

a termination body;

a fixed wedge secured to the termination body and having a plurality of fixed wedge surfaces;

a moving wedge disposed in the termination body having a plurality of moving wedge surfaces interactive with the fixed wedge surfaces, the moving wedge including one or more connecting surfaces extending between moving wedge surfaces of the plurality of moving wedge surfaces, the connecting surfaces disposed perpendicular to a longitudinal direction of the elevator belt in the termination body; and a bearing assembly disposed between the fixed wedge and the moving wedge, the bearing assembly including a plurality of roller elements retained in a roller cage, the roller cage disposed between the fixed wedge and the moving wedge, the roller cage fixed to the termination body;

wherein when the elevator belt is inserted into the termination body between the moving wedge and the termination body and a tension load is applied to the elevator belt, the moving wedge surfaces are urged to move relative to the fixed wedge surfaces to apply a contact pressure to the elevator belt thus retaining the elevator belt at the termination body;

wherein the moving wedge has one or more surface coatings, treatments or patterns thereon to provide high friction to engage the elevator belt.

2. The assembly of claim 1, wherein the termination body is a tubular member.

3. The assembly of claim 1, wherein the fixed wedge surfaces are nonparallel to a rear face of the fixed wedge, the rear face being furthest from the moving wedge.

4. The assembly of claim 1, wherein the moving wedge surfaces are parallel to the fixed wedge surfaces.

5. The assembly of claim 1, wherein the plurality of moving wedge surfaces is three moving wedge surfaces and the plurality of fixed wedge surfaces in three fixed wedge surfaces.

6. An elevator system comprising:

an elevator car suspended in a hoistway via an elevator belt; and a termination assembly to secure the elevator belt at an end of the elevator belt, the termination assembly including:

a termination body;

a fixed wedge secured to the termination body and having a plurality of fixed wedge surfaces; and a moving wedge disposed in the termination body having a plurality of moving wedge surfaces interactive with the fixed wedge surfaces, the moving wedge including one or more connecting surfaces extending between moving wedge surfaces of the plurality of moving wedge surfaces, the connecting surfaces disposed perpendicular to a longitudinal direction of the elevator belt in the termination body; and a bearing assembly disposed between the fixed wedge and the moving wedge such that a non-contact relationship exists between the fixed wedge and the moving wedge, the bearing assembly including a plurality of roller elements retained in a roller cage, the roller cage disposed between the fixed wedge and the moving wedge, the roller cage fixed the termination body;

wherein when the elevator belt is inserted into the termination body between the moving wedge and the termination body and a tension load is applied to the elevator belt, the moving wedge surfaces are urged to move relative to the fixed wedge surfaces to apply a contact pressure to the elevator belt thus retaining the elevator belt at the termination body;

wherein the moving wedge has one or more surface coatings, treatments or patterns thereon to provide high friction to engage the elevator belt.

7. The elevator system of claim 6, wherein the termination body is a tubular member.

8. The elevator system of claim 6, wherein the fixed wedge surfaces are nonparallel to a rear face of the fixed wedge, the rear face being furthest from the moving wedge.

9. The elevator system of claim 6, wherein the moving wedge surfaces are parallel to the fixed wedge surfaces.

10. The elevator system of claim 6, wherein the plurality of moving wedge surfaces is three moving wedge surfaces and the plurality of fixed wedge surfaces in three fixed wedge surfaces.

11. The elevator system of claim 6, wherein the termination assembly is disposed at the elevator car.

12. The elevator system of claim 6, wherein the elevator belt is in an unbent orientation in the termination body.

13. The elevator system of claim 6, wherein tension members of the belt are formed at least partially from a carbon fiber material.

14. The elevator system of claim 6, wherein the elevator belt includes:

a plurality of tension elements extending longitudinally along a belt length and arranged generally spaced apart and parallel to each other; and a jacket in which the plurality of tension elements are retained.

15. A method of terminating an elevator belt comprising:

urging a belt end through a termination body of a termination assembly in a first direction, between the termination body and a moving wedge;

urging the belt in a second direction opposite the first direction, thereby urging movement of the moving wedge relative to a fixed wedge, the moving wedge having a plurality of moving wedge surfaces interactive with a plurality of fixed wedge surfaces of the fixed wedge, the moving wedge including one or more connecting surfaces extending between moving wedge surfaces of the plurality of moving wedge surfaces, the connecting surfaces disposed perpendicular to a longitudinal direction of the elevator belt in the termination body;

urging the moving wedge into contact with the elevator belt via the interaction between the moving wedge and the fixed wedge, thus applying a contact pressure to the elevator belt to retain the elevator belt at the termination body; and transmitting a compressive force from the fixed wedge to the moving wedge via a bearing assembly disposed between the fixed wedge and the moving wedge, the bearing assembly including a plurality of roller elements retained in a roller cage, the roller cage disposed between the fixed wedge and the moving wedge, the roller cage fixed to the termination body;

wherein the moving wedge has one or more surface coatings, treatments or patterns thereon to provide high friction to engage the elevator belt.

* * * * *